US005155877A

United States Patent [19]

Reed

[11] Patent Number: 5,155,877

[45] Date of Patent: Oct. 20, 1992

[54] PLUNGER DEVICE FOR REMOVING LIQUID FROM CARPET

[75] Inventor: Harold L. Reed, Tulsa, Okla.

[73] Assignee: MoCorp, Incorporated, Tulsa, Okla.

[21] Appl. No.: 692,696

[22] Filed: Apr. 29, 1991

[51] Int. Cl.[5] ..... A47L 5/20

[52] U.S. Cl. ..... 151/341; 15/1; 4/255.11

[58] Field of Search ..... 4/257, 255; 15/341, 15/1

[56] References Cited

U.S. PATENT DOCUMENTS

| | | | |
|---|---|---|---|
| 13,096 | 3/1910 | Bimm . | |
| 665,637 | 1/1901 | Grey . | |
| 751,253 | 2/1904 | Brady . | |
| 770,762 | 9/1904 | Lipp . | |
| 1,927,350 | 9/1933 | Schopp | 15/122 |
| 2,983,944 | 5/1961 | Uselis | 15/119 A X |
| 3,644,943 | 2/1972 | Leonardo et al. | 4/255 |
| 3,751,746 | 8/1973 | Elbreder | 15/1 |
| 3,820,182 | 6/1974 | Vockroth | 15/1.7 |
| 4,094,031 | 6/1978 | Cellini | 15/1.7 |

FOREIGN PATENT DOCUMENTS

| | | | |
|---|---|---|---|
| 711628 | 9/1931 | France | 4/255 |

*Primary Examiner*—Chris K. Moore
*Attorney, Agent, or Firm*—Head & Johnson

[57] ABSTRACT

A device for removal of liquid from carpet. The device includes a flexible suction cup having an upward position and a depressed position and absorbent material within the flexible suction cup. A seal is created over the carpet when the flexible suction cup is moved to the depressed position. A vacuum force is created over the carpet when the flexible suction cup is then moved to the upward position in order to draw liquid from the carpet into the absorbent material.

15 Claims, 3 Drawing Sheets

PLUNGER DEVICE FOR REMOVING LIQUID FROM CARPET

BACKGROUND OF THE INVENTION

1. Field of the Invention

The present invention relates to a device to remove liquid from carpet. In particular, the present invention relates to a device that provides a suction force to remove liquid from carpet and provides for simple disposal of the liquid so removed.

2. Prior Art

Raising liquid by use of suction force is known in many applications. Vacuum cleaners and other mechanical devices have been used for this purpose.

Liquid spilled on carpet is a problem, particularly with wall-to-wall carpet which is often difficult to remove. The spilled liquid will quickly disperse and must be brought to the surface and removed to prevent the carpet and underlying floor from being damaged.

Applicant is aware of the following U.S. patents.

| U.S. Pat. No. | INVENTOR |
|---|---|
| RE 13,096 | Bimm |
| 665,637 | Grey |
| 751,253 | Brady |
| 770,762 | Lipp |
| 1,927,350 | Schopp |
| 3,751,746 | Elbreder |
| 3,820,182 | Vockroth |
| 4,094,031 | Cellini |

Elbreder (U.S. Pat. No. 3,751,746) discloses a sponge material on a handle for soaking up liquids. After being drawn into the sponge material, the sponge material may then be pressed against a perforated plate mounted within a container which is used to collect liquid.

Lipp (U.S. Pat. No. 770,762) and Bimm (U.S. Pat. No. Re 13,096) disclose pumps provided with manually operated pistons to draw air for removal of dust.

Grey (U.S. Pat. No. 665,637) discloses a blackboard eraser having a dust suction valve to draw chalk dust into a chamber.

Brady (U.S. Pat. No. 751,253) discloses an air pump providing a current of air to force accumulation of chips from a drilled hole.

Vockroth (U.S. Pat. No. 3,820,182) discloses an underwater cleaner having a pump to draw water and debris therein.

Cellini (U.S. Pat. No. 4,094,031) discloses an underwater vacuum suction device.

It can be seen that the idea of lifting liquid with a manually operated pump or vacuum mechanism is known. No references, however, disclose the use of a suction or vacuum mechanism in combination with an absorption material to remove a liquid.

Accordingly, it is a principal object and purpose of the present invention to provide a device to remove liquid from carpet by creating a seal around a portion of the carpet, providing a suction or vacuum force on the carpet to lift the liquid from the carpet, and providing an absorption material to retain the liquid so removed.

SUMMARY OF THE INVENTION

The present invention is directed to a device for removal of liquid from carpet. A flexible suction cup includes an open end and a closed end. In one embodiment, the suction cup is substantially conical with the open end terminating in a circular edge.

Extending from the closed end of the flexible suction cup is a cylindrical handle which is received in a receptacle at the closed end of the flexible suction cup. The handle extends outward along the axis of the conical suction cup.

The handle is utilized to move the flexible suction cup between an upward position and a depressed position. To move the suction cup to the depressed position, the handle is moved vertically downward. Conversely, to move the suction cup to the upward position, the handle is moved vertically upward.

The interior of the flexible suction cup is filled with an absorbent material, such as sponge.

In order to remove liquid from a carpet, the open end of the flexible suction cup is placed over and on top of a section of carpet while the cup is in the upward position. The handle will then be moved vertically downward so that the cup is in the depressed position. A seal is, thus, created between the suction cup and the carpet section. The handle will then be moved vertically upward so that the suction cup returns to the upward position without the suction cup moving away from the carpet. As this action takes place, the volume of the suction cup will increase, causing a vacuum force to be created. Liquid retained in the carpet will be drawn upward into the suction cup.

As the liquid enters the suction cup, it will be absorbed into the absorbent sponge.

The liquid removed from the carpet into the absorbent sponge may be extracted by use of an extraction stand. The extraction stand has a series of feet, an open bottom, and a receptacle area slightly larger than the suction cup. Within the receptacle area is a perforated plate that has a plurality of openings. The open end of the suction cup is moved into the receptacle area above the perforated plate. The handle is then depressed so that the absorbent sponge is squeezed and reduced in size so that the liquid is forced out through the openings, where it is safely drained away.

DETAILED DESCRIPTION OF THE PREFERRED EMBODIMENTS

Figure 1:
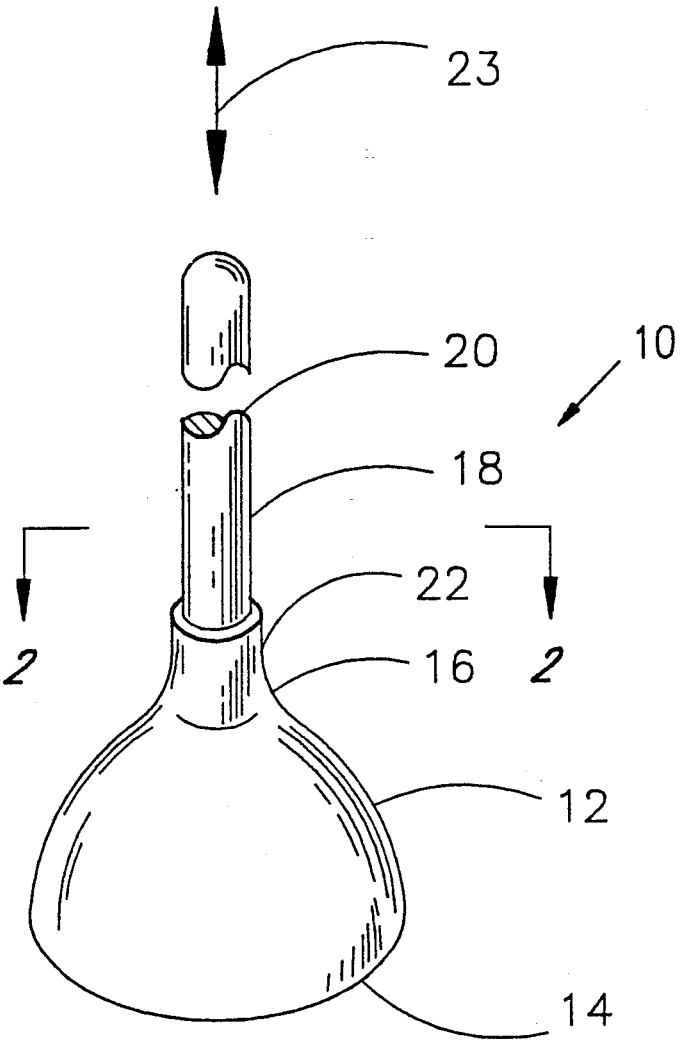
FIG. 1 is a perspective view of a plunger device for removing liquid from carpet constructed in accordance with the present invention.

Referring to the drawings in detail, FIG. 1 depicts a perspective view of a device 10 for removal of liquid from carpet. The device has been found to be particularly useful where a spill or leak has occurred on wall-to-wall carpeting.

A flexible suction cup 12 includes an open end 14 and a closed end 16. The suction cup is constructed of a flexible material, such as rubber that is resistant to corrosive liquids. In FIG. 1, the suction cup is substantially conical with the open end 14 terminating in a circular edge.

Extending from the closed end 16 of the flexible suction cup 12 is a handle 18. In the present embodiment, the handle is a cylindrical shaft. The handle extends outward along the axis (not shown) of the conical suction cup 12. The handle, shown broken at 20 for ease of illustration, is constructed of any rigid, material resistant to corrosive liquids, such as wood. The handle may be glued to the closed end 16 or may be threaded in a receptacle 22 at the closed end of the suction cup. It will be recognized that movement of the handle imparts movement to the closed end 16 of the suction cup.

The handle and the suction cup operate as a plunger type device. The handle 18 is utilized to move the flexible suction cup 12 between an upward position, as seen in FIG. 1, and a depressed position. The movement of the handle is illustrated by the arrow 23. To move the suction cup to the depressed position, the handle 18 is moved vertically downward from the position shown in Figure 1. Conversely, to move the suction cup to the upward position, the handle 18 is moved vertically upward back to the position seen in FIG. 1.

Figures 2, 4, 5:
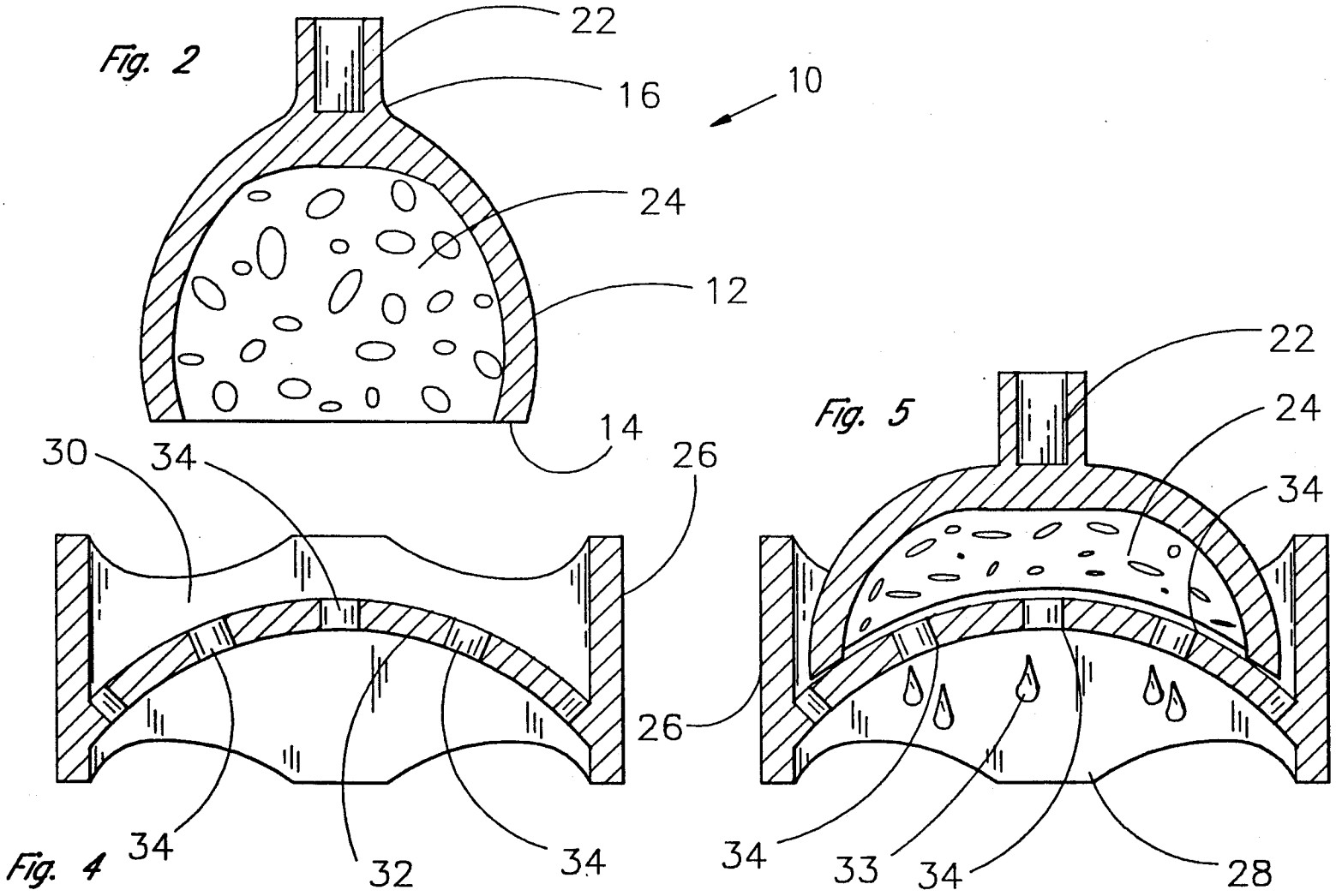
FIG. 2 is a sectional view of the plunger device for removing liquid from carpet taken along section line 2—2 of FIG. 1.
FIG. 4 is a sectional view taken along section line 4—4 of FIG. 3.
FIG. 5 is a sectional view of the plunger device for removing liquid from carpet in use with the extraction stand constructed in accordance with the present invention.

FIG. 2 is a sectional view of the device 10 taken along section line 2—2 of FIG. 1. The interior of the flexible suction cup 12 is filled with an absorbent material, such as a sponge 24. It will be understood that other material capable of absorbing liquid would also be suitable. The absorbent material will have the ability of absorbing and retaining liquid brought into contact therewith.

The sponge fills the entire interior cavity of the flexible suction cup and is affixed to the interior of the flexible suction cup by adhesive. It will be recognized that the sponge and suction cup might be arranged so that the sponge is removable and replaceable.

The operation of the apparatus may be observed through use with a liquid spill on a section of carpet. Such liquid spills might occur for a variety of reasons including plumbing leaks, sewage leaks or flooding. In order to remove liquid from a carpet through use of the device 10, the open end 14 of the flexible suction cup is placed over and on top of a section of carpet (not shown) while the cup is in the upward position. The handle 18 will then be moved vertically downward so that the cup is in a depressed position. A seal is, thus, created between the suction cup and the carpet section. The handle 18 will then be moved vertically upward so that the suction cup returns to the upward position without the suction cup moving away from the carpet. As this action takes place, the volume of the suction cup will increase, causing a vacuum force to be created. Since the carpet is somewhat porous, liquid retained in the carpet will be drawn upward into the suction cup.

As the liquid enters the suction cup, it will be absorbed into the absorbent sponge 24 and retained. Because of this vacuum action, not only will liquid on the surface of the carpet be absorbed but liquid soaked in the carpet will be brought into the absorbent sponge. It has been observed that liquid will be drawn into the absorbent sponge from an area of carpet exceeding the boundary of the open end 14 of the suction cup.

The liquid extracted from the carpet in the absorbent sponge may then be easily carried away for disposal in a number of ways. The device may be carried by its handle 18 to a sink where the suction cup is again depressed over a sink (not shown) to squeeze the liquid from the absorbent sponge. The liquid retained in the sponge will be purged from the sponge.

Figure 3:
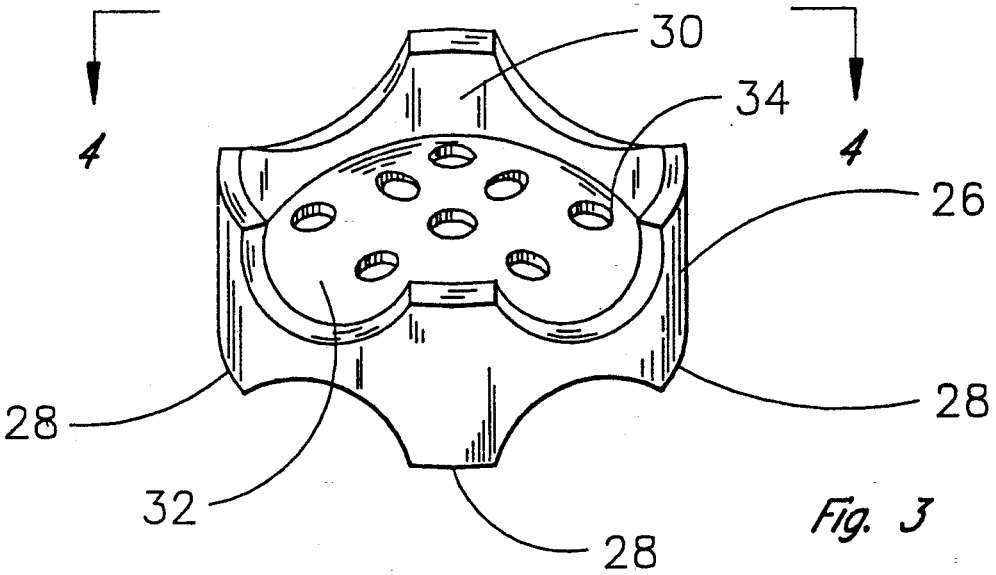
FIG. 3 is a perspective view of an extraction stand for use with the plunger device for removing liquid from carpet as seen in FIG. 1.

An alternate method of extracting the liquid removed by the device is seen in FIGS. 3 and 4, FIG. 4 being a sectional view taken along section lines 4—4 of FIG. 3. An extraction stand 26 has a series of feet 28 so that the stand may be placed in a sink or on a flat surface. The extraction stand 26 has a receptacle area 30 that is slightly larger in dimension than the suction cup 12 so that the open end 14 of the suction cup may be received therein. Within the receptacle area 30 is a perforated plate 32 that has a plurality of openings 34.

To extract the liquid which has been removed from the carpet, the handle is moved so that the open end 14 of the suction cup 12 is in the receptacle area 30 above the perforated plate 32. The handle is then depressed, as best seen in FIG. 5, so that the absorbent sponge is squeezed and reduced in size so that the liquid drops 33 are forced out through the openings 34, where it is safely drained away. It will be observed that the perforated plate 32 is arcuate, in order to enhance the removal of the liquid from the sponge material.

A salient benefit of the extraction stand 26 is that it may also be used as a storage stand for the device 10 when not in use. The extraction stand may be constructed of any rigid material that is resistant to corrosive liquids. The extraction stand is portable and may be placed in a sink, in a pail or outside on the ground. The extraction stand might also be constructed so as to be affixed within a pail or other container so that the liquid removed is retained in the pail.

Once the procedure has been performed, it may be repeated over another section of carpet. From the foregoing, it will be observed that unsanitary corrosive liquids may be removed from carpets without ever having to physically touch the liquid. The device also has advantages over vacuum cleaners and other such mechanisms since the unsanitary or corrosive liquid does not have to come into contact with the vacuum cleaner or other mechanism.

Figure 6:
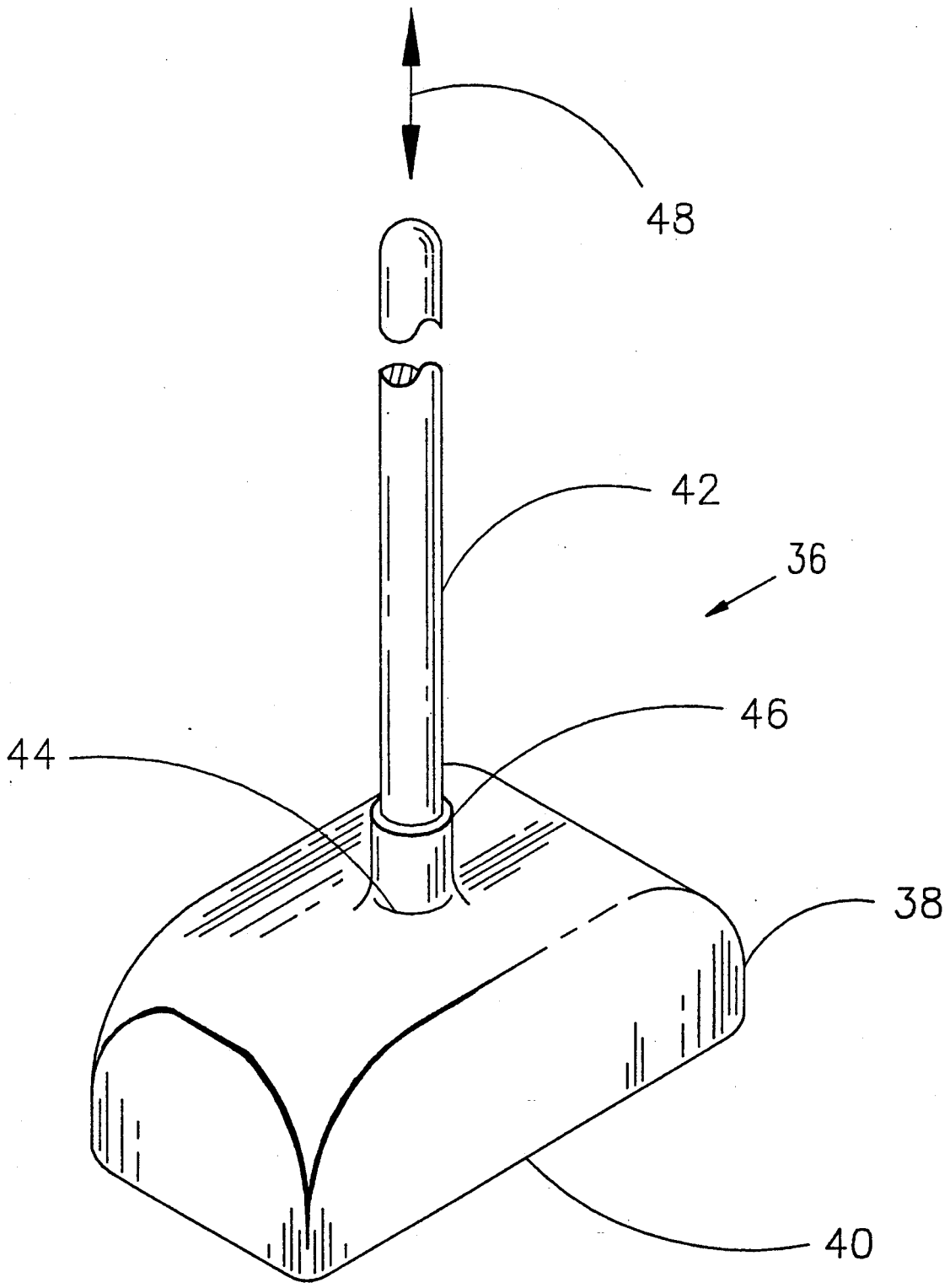
FIG. 6 is an alternate embodiment of a plunger device for removing liquid from carpet.

FIG. 6 is an alternate embodiment 36 of a device for removal of liquid from carpet. Rather than the flexible suction cup being conical, the flexible suction cup 38 is rectangular in cross section or pyramidal. The open end 40 of the flexible suction cup terminates in a rectangular edge. A handle 42 extends outward from a receptacle 46 at the closed end 44 of the flexible suction cup. The movement of the handle is illustrated by the arrow 48.

The rectangular shape of the flexible suction cup permits coverage of a large area of carpet and permits utilization in corners.

Whereas, the present invention has been described in relation to the drawings attached hereto, it should be understood that other and further modifications, apart from those shown or suggested herein, may be made within the spirit and scope of this invention.

What is claimed is:

1. An apparatus for removal of liquid from carpet which comprises:

a flexible suction cup having an upward position and a depressed position;

absorbent material within said flexible suction cup;

means to create a seal over said carpet when said flexible suction cup is moved to said depressed position; and means to create a vacuum force over said carpet when said flexible suction cup is moved to said upward position in order to draw liquid from said carpet into said absorbent material.

2. An apparatus for removal of liquid from carpet as set forth in claim 1 wherein said absorbent material is a sponge.

3. An apparatus for removal of liquid from carpet as set forth in claim 1 wherein said flexible suction cup is substantially conical.

4. An apparatus for removal of liquid from carpet as set forth in claim 1 wherein said flexible suction cup is substantially pyramidal.

5. An apparatus for removal of liquid from carpet as set forth in claim 1 wherein said absorbent material is affixed to said flexible suction cup by adhesive.

6. An apparatus for removal of liquid from carpet as set forth in claim 1 including extraction means which will receive said flexible suction cup in order to extract said liquid drawn into said absorbent material.

7. An apparatus for removal of liquid from carpet as set forth in claim 6 wherein said extraction means includes a stand having a perforated plate so that said flexible suction cup and said absorbent material may be pressed against said perforated plate to extract said liquid from said absorbent material.

8. An apparatus for removal of liquid from carpet which comprises:

a flexible suction cup;

a handle attached to said cup movable between an upward position and a depressed position; and absorbent material within said flexible suction cup, wherein a seal is created in said cup when said cup is moved over said carpet and said handle is moved to said depressed position and wherein a vacuum force is created in said cup when said cup is retained over said carpet and said handle is moved to said upward position, thereby drawing liquid from said carpet into said absorbent material.

9. An apparatus for removal of liquid from carpet as set forth in claim 8 wherein said absorbent material is a sponge.

10. An apparatus for removal of liquid from carpet as set forth in claim 8 wherein said absorbent material is affixed to said flexible suction cup by adhesive.

11. An apparatus for removal of liquid from carpet as set forth in claim 8 wherein said flexible suction cup is substantially conical.

12. An apparatus for removal of liquid from carpet as set forth in claim 8 wherein said flexible suction cup is substantially pyramidal.

13. An apparatus for removal of liquid from carpet as set forth in claim 8 including extraction means to extract said liquid drawn into said absorbent material.

14. An apparatus for removal of liquid from carpet as set forth in claim 13 wherein said extraction means includes a stand having a perforated plate so that said flexible suction cup and said absorbent material may be pressed against said perforated plate to extract said liquid from said absorbent material.

15. A process of removing liquid from carpet which method comprises:

creating a seal around a section of said carpet by depressing a suction cup over said carpet section; drawing liquid upward from said carpet section by moving said suction cup to an upward position; absorbing said liquid drawn upward into an absorbent material with said suction cup; and extracting said absorbed liquid from said absorbent material.

* * * * *